US007244052B2

(12) United States Patent
Lee

(10) Patent No.: US 7,244,052 B2
(45) **Date of Patent: *Jul. 17, 2007**

(54) DECORATIVE LAMP

(75) Inventor: Steve Lee, Park Ridge, IL (US)

(73) Assignee: LumiSource, Inc., Elk Grove Village, IL (US)

( * ) Notice: Subject to any disclaimer, the term of this patent is extended or adjusted under 35 U.S.C. 154(b) by 38 days.

This patent is subject to a terminal disclaimer.

(21) Appl. No.: 11/011,665

(22) Filed: Dec. 14, 2004

(65) Prior Publication Data

US 2006/0126350 A1 Jun. 15, 2006

(51) Int. Cl.
*F21S 8/08* (2006.01)

(52) U.S. Cl. ..... 362/413; 362/288; 362/419; 362/427; 362/429

(58) Field of Classification Search ..... 362/250, 362/274, 288, 410, 413, 427–429; D26/62, D26/93

See application file for complete search history.

(56) References Cited

U.S. PATENT DOCUMENTS

| | | | | |
|---|---|---|---|---|
| 1,790,500 | A * | 1/1931 | Fischer | 248/160 |
| 2,397,466 | A * | 4/1946 | Bryant | 362/358 |
| 3,531,636 | A * | 9/1970 | Birch | 40/432 |
| D230,304 | S | 2/1974 | Sara | |
| 5,626,418 | A | 5/1997 | Angelis, Sr. et al. | |

* cited by examiner

*Primary Examiner*—Sandra O'Shea
*Assistant Examiner*—Jason Moon Han
(74) *Attorney, Agent, or Firm*—Pauley Petersen & Erickson

(57) ABSTRACT

A decorative lamp that includes a base and a poseable stem that extends from the base. A spring is connected with respect to an end of the poseable stem opposite the base and a wire is routed through the poseable stem and through the spring and into a socket positioned at an end of the spring opposite the poseable stem. A vibrator may be positioned on the decorative lamp to impart a motion to the socket.

15 Claims, 4 Drawing Sheets

DECORATIVE LAMP

BACKGROUND OF THE INVENTION

1. Field of the Invention

This invention relates to a decorative lamp including a poseable stem and an adjoining spring on which a bulb and lampshade are mounted.

2. Description of Related Art

Lamps generally include a base and a static neck and shade. Reading lamps may include a hinged, cantilevered neck for placement of the light source in a desired location. In addition, flashlights having articulating and flexible stems are available for directing and fixing a light source into a desired location.

SUMMARY OF THE INVENTION

According to a preferred embodiment of this invention, a decorative lamp preferably includes a base at one end and a socket at an opposite end. The socket accommodates one or more varieties of light bulbs, such as a standard incandescent light bulbs.

The decorative lamp according to this invention further includes one or more mounts that extend between the base and the socket. Each mount includes a poseable stem and a spring. The poseable stem is preferably flexible and positionable in any number of configurations and positions. The spring is preferably connected with respect to one end of the poseable stem and includes an opposite end attached to the socket.

Additionally, a decorative lampshade may be attached with respect to the socket and may include one or more moveable elements that respond to a vibrating or oscillating motion imparted from the spring.

According to one preferred embodiment of this invention, a vibrator may be connected with respect to the decorative lamp that imparts a vibrating motion to the spring. As a result, the decorative lampshade moves during operation of the vibrator.

The lamp may further include multiple poseable stems and corresponding springs and sockets extending from the base. This configuration results in multiple light sources having articulating mounts.

BRIEF DESCRIPTION OF THE DRAWINGS

The drawings show a decorative lamp, according to preferred embodiments of this invention, wherein.

DETAILED DESCRIPTION OF THE PREFERRED EMBODIMENTS

Figure 1:
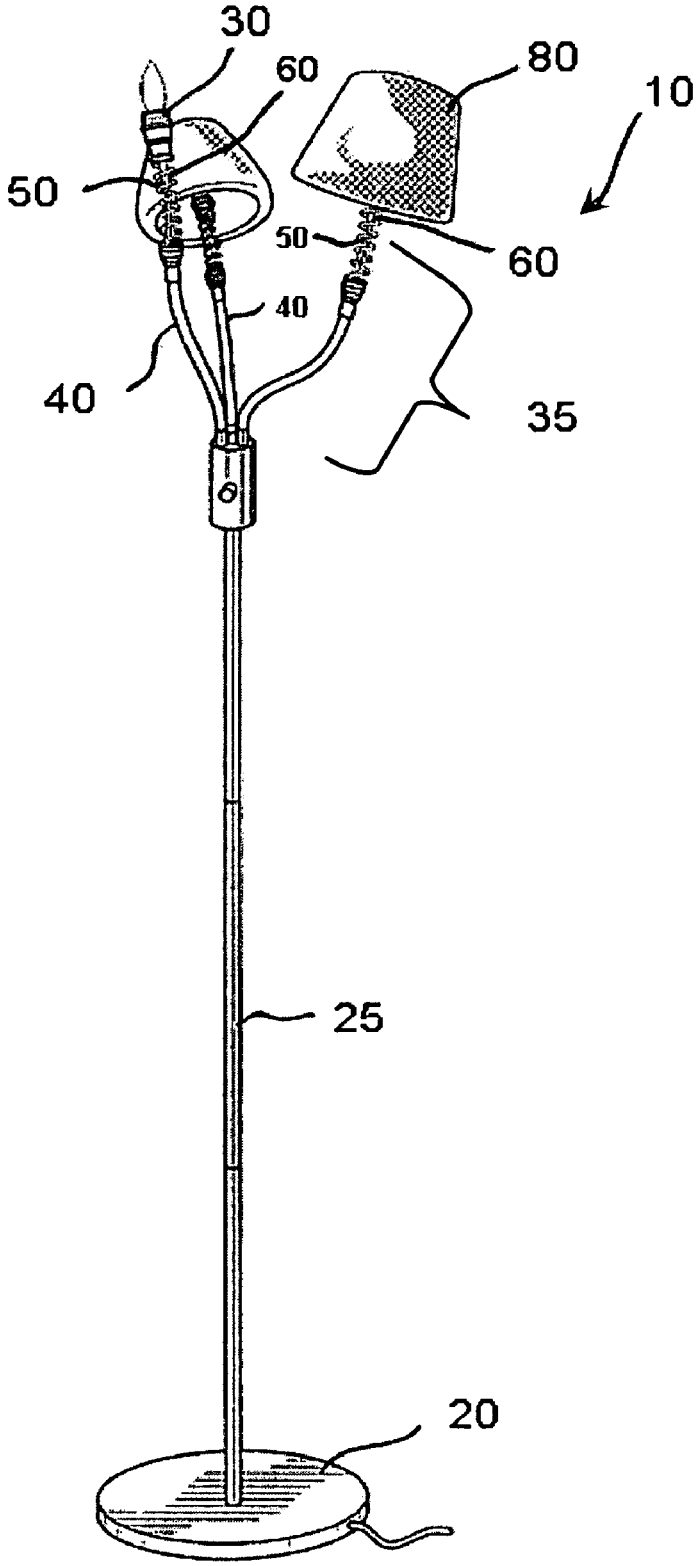
FIG. 1 is a front perspective view of a decorative lamp, according to one preferred embodiment of this invention.

FIGS. 1–4 show various views and embodiments of decorative lamp 10 according to preferred embodiments of this invention. As shown in FIG. 1, decorative lamp 10 preferably includes base 20 at one end and socket 30 at an opposite end. Socket 30 preferably accommodates one or more varieties of light bulbs, such as a standard incandescent light bulb.

Figure 3:
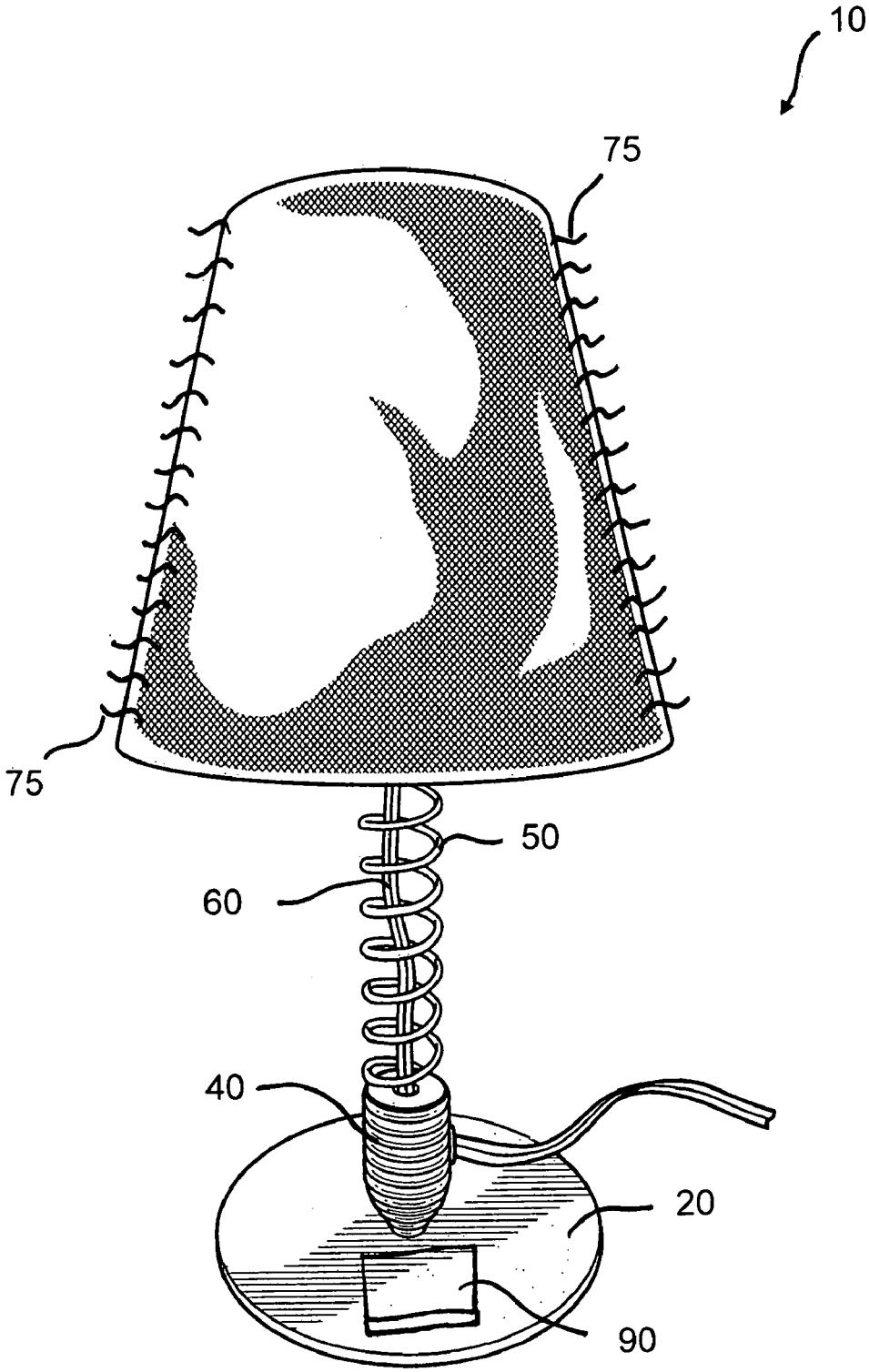
FIG. 3 is a front perspective view of a decorative lamp, according to one preferred embodiment of this invention.
Figure 4:
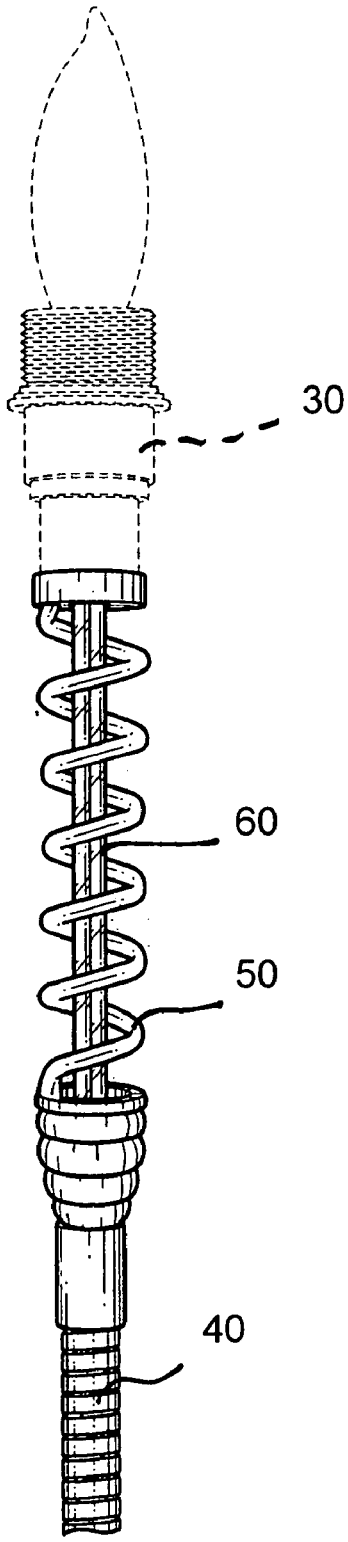
FIG. 4 is a front view of a portion of the decorative lamp shown in FIG. 1.

Decorative lamp 10 preferably includes base 20 and may further include an extension 25 for a floor lamp such as shown in FIG. 1 or, in the case of a table lamp such as shown in FIG. 3, may transition directly into poseable stem 40 or spring 50, as described in more detail below. Decorative lamp 10 may be largely constructed of metal, plastic or any other suitable material known to those having ordinary skill in the art.

Decorative lamp 10 preferably includes one or more mounts 35 that extend between base 20 and socket 30. According to a preferred embodiment of this invention, mount 35 includes poseable stem 40 and spring 50. Poseable stem 40 extends, either directly or indirectly, from base 20 and is preferably formed of a flexible conduit. As a result, poseable stem 40 is flexible and positionable in any number of configurations and positions.

Spring 50 is preferably connected with respect to one end of poseable stem 40. Spring 50 is preferably fixed to one end of poseable stem 40 and includes an opposite end attached to socket 30. As a result of this configuration, spring 50 is preferably freely moveable from the one end of poseable stem 40. Spring 50 preferably includes a plurality of loosely wound coils resulting in a loose spring that is responsive to even gentle stimulus. In addition, spring 50 is preferably sufficiently rigid to support socket 30 and lampshade 80.

Wire 60 preferably extends through poseable stem 40 and through a center portion of spring 50 and into socket 30. Wire 60 preferably comprises a power wire and is used to provide power from a standard wall outlet to socket 30 and the bulb. Wire 60 is preferably stretched taut through a center of spring 50 so as to not interfere with the free movement of spring 50. In addition, wire 60 is preferably visible between the coils of spring 50, as shown in FIGS. 1–4.

Decorative lampshade 80 may be attached with respect to socket 30. Decorative lampshade 80 may include one or more moveable elements 75 that respond to the vibrating motion. For example, a plurality of feathers may be attached with respect to decorative lampshade 80 to enhance or accentuate an oscillating and/or vibrating motion created by spring 50 and/or vibrator 90, as discussed below. Such moveable elements 75 thereby respond and react to movement of decorative lampshade 80 and/or socket 30.

According to one preferred embodiment of this invention, vibrator 90 may be connected with respect to base 20, poseable stem 40, spring 50 and/or socket 30. Vibrator 90 preferably imparts a vibrating motion to the spring. FIG. 3 shows a preferred embodiment of this invention having vibrator 90 connected to base 90 and, when activated, imparting motion to spring 50. As a result, decorative lampshade 80 moves during operation of vibrator 90. Alternatively, vibrator 90 may be connected with respect to spring 50 to impart motion to spring 50 and socket 30.

Figure 2:
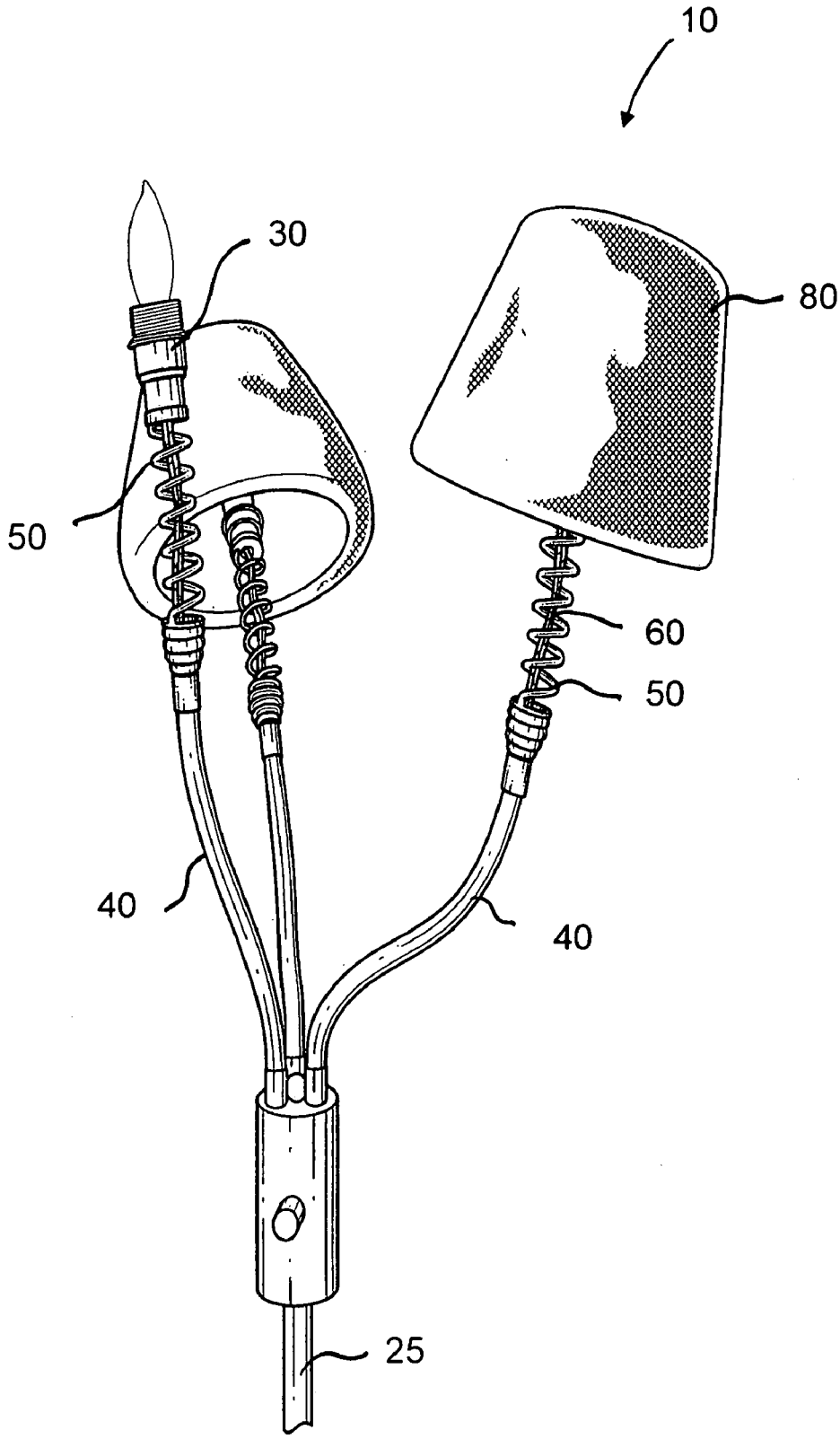
FIG. 2 is a front perspective view of a portion of the decorative lamp shown in FIG. 1.

As shown in FIGS. 1 and 2, lamp 10 may include a plurality of poseable stems 40 and corresponding springs 50 and sockets 30 extending either directly from base 20 or from extension 25 of base 20. More specifically, a trio of poseable stems 40 extend from extension 25 and base 20 shown in FIGS. 1 and 2.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed:

1. A decorative lamp comprising:

a poseable stem including a flexible conduit;

a spring with a plurality of loosely wound coils responsive to gentle stimulus, the spring having a proximal end and a distal end, the proximal end connected to and extending from one end of the poseable stem;

a wire extending from the one end of the poseable stem and visible through a center portion of the spring;

a socket attached to the distal end of the spring opposite the one end of the poseable stem, the wire connected to the socket; and a decorative lampshade attached to the socket so that the distal end of the spring transmits a vibrating or oscillating motion.

2. The decorative lamp of claim 1 further comprising:

a base connected with respect to an end of the poseable stem opposite the one end; and a vibrator connected to the base, the vibrator imparting motion to the spring.

3. The decorative lamp of claim 1 further comprising:

a vibrator connected with respect to the spring, the vibrator imparting motion to the spring.

4. The decorative lamp of claim 1 further comprising:

a base; and a plurality of poseable stems and corresponding springs and sockets extending from the base.

5. The decorative lamp of claim 1 further comprising:

a plurality of feathers attached with respect to the decorative lampshade.

6. The decorative lamp of claim 1 further comprising:

a base;

a trio of poseable stems extending from the base, each poseable stem including a spring and a socket.

7. A decorative lamp comprising:

a base;

a poseable stem including a flexible conduit extending from the base;

a spring with a plurality of loosely wound coils responsive to gentle stimulus, having a proximal end and a distal end, the proximal end connected to and extending from one end of the poseable stem opposite the base;

a vibrator connected with respect to at least one of the base, the poseable stem, the spring and the socket, the vibrator imparting a vibrating motion to the spring;

a wire extending from one end of the poseable stem and visible through a center portion of the spring; and a socket attached to the distal end of the spring opposite the one end of the poseable stem, the wire connected to the socket.

8. The decorative lamp of claim 7 further comprising:

a decorative lampshade connected with respect to the socket, the decorative lampshade having one or more moveable elements that respond to the vibrating motion.

9. The decorative lamp of claim 7 further comprising:

a plurality of poseable stems extending from the base, each poseable stem having a corresponding spring and socket.

10. The decorative lamp of claim 7 wherein the wire extends through the flexible conduit.

11. A mount for connecting between a socket and a base of a decorative lamp comprising:

including a flexible conduit extending from the base;

a spring with a plurality of loosely wound coils responsive to gentle stimulus attached to one end of the poseable stem opposite the base; a vibrator connected to the base, the vibrator for vibrating the spring thereby imparting motion to the socket; and a wire extending from the base and through the poseable stem and visible through the spring and into the socket.

12. The mount of claim 11 further comprising:

a lampshade positioned around the socket, the lampshade having a plurality of moveable elements.

13. A decorative lamp having a base at one end and at least one socket for a bulb at an opposite end, the decorative lamp comprising:

a spring with a plurality of loosely wound coils responsive to gentle stimulus positioned between the at least one socket and the base; and a wire extending from the base and visibly through the spring and into the socket;

a vibrator linked with respect to the spring, the vibrator for vibrating the spring thereby imparting motion to the at least one socket and a lampshade surrounding the socket, the lampshade including a plurality of moveable elements that respond to the motion of the socket.

14. The decorative lamp of claim 13 further comprising:

a poseable stem positioned between the spring and the base, the wire extending through the poseable stem and into the spring.

15. The decorative lamp of claim 13 further comprising:

a plurality of springs extending from the base, each spring having a corresponding socket.

* * * * *

UNITED STATES PATENT AND TRADEMARK OFFICE

CERTIFICATE OF CORRECTION

PATENT NO. : 7,244,052 B2
APPLICATION NO. : 11/011665
DATED : July 17, 2007
INVENTOR(S) : Steve Lee It is certified that error appears in the above-identified patent and that said Letters Patent is hereby corrected as shown below:

Column 4, line 17, insert --a poseable stem -- before “including a flexible”.

Signed and Sealed this

Twentieth Day of November, 2007

JON W. DUDAS
*Director of the United States Patent and Trademark Office*